US006577286B1

(12) United States Patent
Jang

(10) Patent No.: US 6,577,286 B1
(45) Date of Patent: Jun. 10, 2003

(54) DEVICE AND METHOD OF DISPLAYING IMAGES

(76) Inventor: Ji Ho Jang, 26/8, 124-36 Namgajwa 1-dong, Seodaemun-gu, Seoul 120-121 (KR)

( * ) Notice: Subject to any disclaimer, the term of this patent is extended or adjusted under 35 U.S.C. 154(b) by 0 days.

(21) Appl. No.: 09/674,481

(22) PCT Filed: Jan. 6, 1999

(86) PCT No.: PCT/KR99/00023

§ 371 (c)(1),
(2), (4) Date: Nov. 8, 2000

(87) PCT Pub. No.: WO99/35634

PCT Pub. Date: Jul. 15, 1999

(30) Foreign Application Priority Data

Jan. 6, 1998 (KR) ..... 98-76

(51) Int. Cl.[7] ..... G09G 3/00

(52) U.S. Cl. ..... 345/31; 345/46; 345/82; 340/815.45

(58) Field of Search ..... 345/31, 44, 46, 345/82, 88, 110; 340/815.45, 815.53, 815.4

(56) References Cited

U.S. PATENT DOCUMENTS 4,160,973 A * 7/1979 Berlin, Jr. ..... 345/31
5,057,827 A * 10/1991 Nobile et al. ..... 345/31
5,302,965 A * 4/1994 Belcher et al. ..... 345/31
5,818,401 A * 10/1998 Wang ..... 345/31
6,265,984 B1 * 7/2001 Molinaroli
6,278,419 B1 * 8/2001 Malkin ..... 345/31

FOREIGN PATENT DOCUMENTS

EP 025206 * 3/1981

* cited by examiner

*Primary Examiner*—Regina Liang
(74) *Attorney, Agent, or Firm*—Burns, Doane, Swecker & Mathis, L.L.P.

(57) ABSTRACT

A device and method of displaying images using an after-image caused by an optical illusion is disclosed In the device, a controller processes image data output from an image processing unit, thus generating an image display control signal and a motor control signal. A drive motor unit rotates a rotary display assembly at a speed in response to the motor control signal. A plurality of display units, individually designed to emit light beams at multi-angles, are orderly mounted on the rotary display assembly. The display assembly is rotated at a speed by the drive motor unit in response to the motor control signal while displaying images on the display units at multi-angles in response to the image display control signal, thus forming desired images due to an afterimage caused by an optical illusion.

22 Claims, 7 Drawing Sheets

FIG.9a
FIG.9b
FIG.9c
FIG.9d
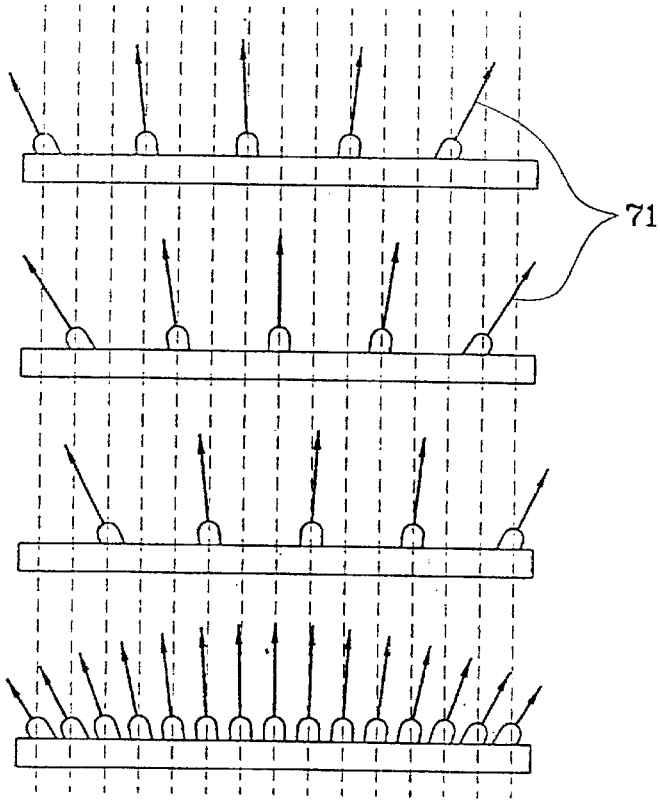
FIG.10
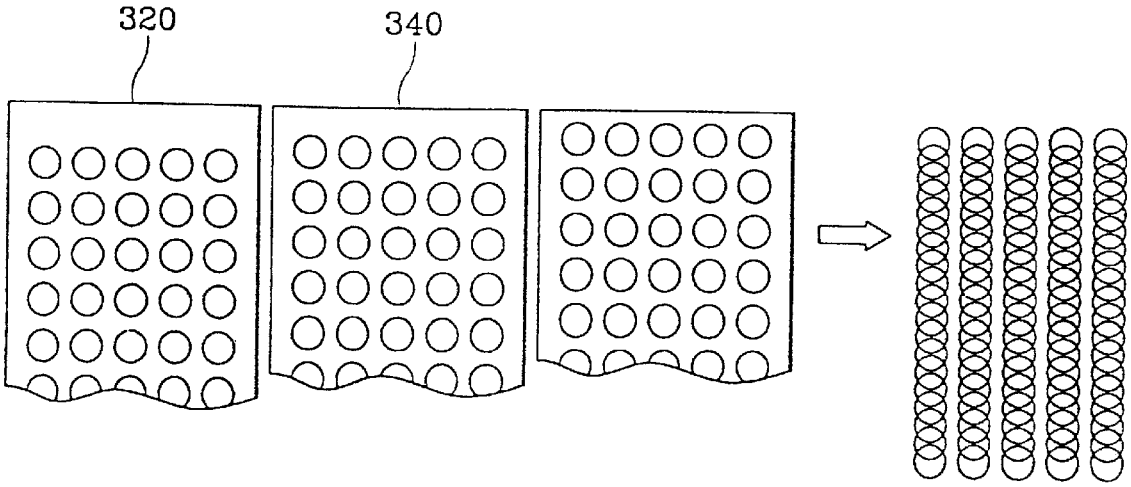

DEVICE AND METHOD OF DISPLAYING IMAGES

TECHNICAL FIELD

The present invention relates, in general, to a device and method of di%splaying images and, more particularly, to a device and method of displaying images due to an afterimage caused by an optical illusion formed by rotating a rotary display assembly, comprising a plurality of display units capable of individually emitting light beams at multi-angles, at a high speed.

BACKGROUND ART

Several techniques for displaying images on a screen have been well known to those skilled in the art. For example, in the case of television receivers, a plurality of electron beams are scanned from an electron gun onto a screen, thus activating pixels on the screen so as to form a desired picture thereon. Second, it is also possible to form a desired picture on a screen by projecting a film, having a developed image, on the screen. That is, a film, with a developed image, is projected by a projector onto a screen, thus forming a desired picture on said screen. Third, a plurality of LEDs (light emit diodes), constituting an LED display board, may be used for displaying images. That is, the LEDs of a display board are selectively turned on or off under the control of a controller, thus forming a desired picture on the board.

However, the above-mentioned typical techniques for displaying images using television receivers, projectors or LED display boards are problematic in that the images are merely visible by viewers positioned within a fixedly directed and limited area. Therefore, a person, placed on an area out of the fixedly directed and limited area, has a difficulty while seeing the image. In addition, the above techniques fail to allow a person, placed in, the back of the screen, to see the pictures on the screen. Particularly, the known LED display boards, individually comprising a plurality of LEDs, are so large in their sizes and volumes, so that use of the LED display boards is undesirably limited to outdoor sign boards.

DISCLOSURE OF THE INVENTION

Accordingly, the present invention has been mate keeping in mind the above problems occurring in the prior art, and an object of the present invention is to provide a device for displaying images due to an afterimage caused by an optical illusion formed by rotating a rotary display assembly, comprising a plurality of display units capable of individually emitting light beams at multi-angles, at a high speed.

In order to accomplish the above objects the present invention provides a device for displaying images, comprising: a controller selectively processing image data output from an image processing unit so a to generate an image display control signal, the controller also generating a motor control signal; a drive motor unit selectively rotated at a speed in response to the motor control signal output from the controller; and a rotary display assembly comprising a plurality of image display units capable of individually emitting light beams at multi-angles, the assembly being-rotatable at a speed by the drive motor unit and selectively displaying images on the display units in response to the image display control signal output from the controller.

Another object of the present invention is to provide a method of displaying images due to an afterimage caused by an optical illusion formed by rotating a rotary display assembly, comprising plurality of display units capable of individually emitting light beams at multi-angles, at a high speed.

In order to accomplish the above object, the present invention provides a method of displaying image, comprising the steps of: rotating a rotary display assembly at a speed by a drive motor unit while emitting light beams from a plurality of display units of the display assembly at multi-angles, thus forming an image due to an afterimage caused by an optical illusion.

BRIEF DESCRIPTION OF THE DRAWINGS

The above and other objects, features and other advantages of the present invention will be more clearly understood from the following detailed description taken in conjunction with the accompanying drawings, in which:

FIGS. 9*a* to 9*d* are views, illustrating a method of accomplishing a high horizontal resolution of the image display device of this invention;

FIG. 10 is a view, illustrating a method of accomplishing a high vertical resolution of the image display device of this invention.

BEST MODE FOR CARRYING OUT THE INVENTION

Figure 1:
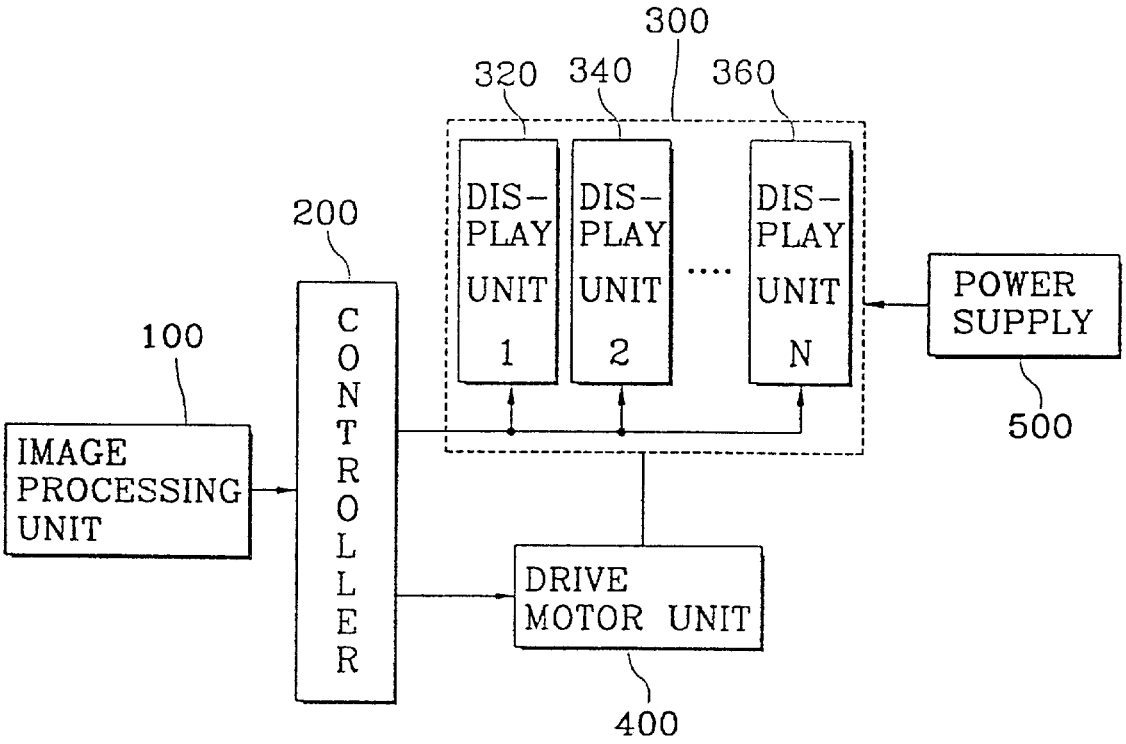
FIG. 1 is a block diagram, showing the construction of an image display device in accordance with tie preferred embodiment of the present invention.

FIG. 1 is a block diagram, showing the construction of an image display device in accordance with the preferred embodiment of this invention. As shown in the drawing, the device of this invention comprises an image processing unit 100, a controller 200, a rotary display assembly 300, a drive motor unit 400, and a power supply 500.

In the above d splay device, the image processing unit 100 may reproduce image data from an image storage medium, such as a compact disk, a video cassette tape or a hard disk, prior to transmitting the image data to the controller 200. The above processing unit 100 also may receive public waves, output from a broadcasting station, prior to transmitting image data of the public waves to the controller 200.

Upon receiving image data from the image processing unit 100, the controller 200 selectively processes the image data prior to generating an image display control signal. The above control signal is applied to the rotary display assembly 300 so as to allow said assembly 300 to display desired images. The controller 200 also generates a motor control signal. The motor control signal is applied to the drive motor unit 400 so as to rotate the display assembly 300 at a speed, at which the assembly 300 is rotated with about thirty display units 320, 340 and 360 passing a position in front of a viewer.

The rotary display assembly 300, comprising a plurality of display units 320, 340 and 360, displays desired images on the display units 320, 340 and 360 in response to the image display control signal output from the controller 200. The drive motor unit 400 rotates the display assembly 300 at a speed in response to the motor control signal output from the controller 200. The power supply 500 is used for supplying an electric power to each of the display units 320, 340 and 360 of the assembly 300.

Figure 2:
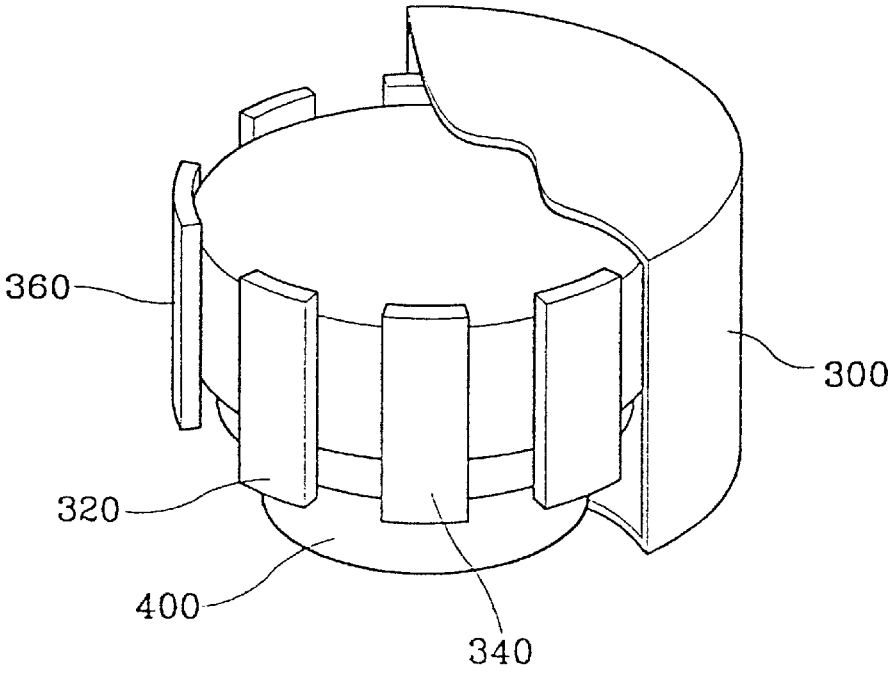
FIGS. 2 to 4 are views, respectively showing the construction of rotary display assemblies in accordance with different embodiments of the present invention.
Figure 3:
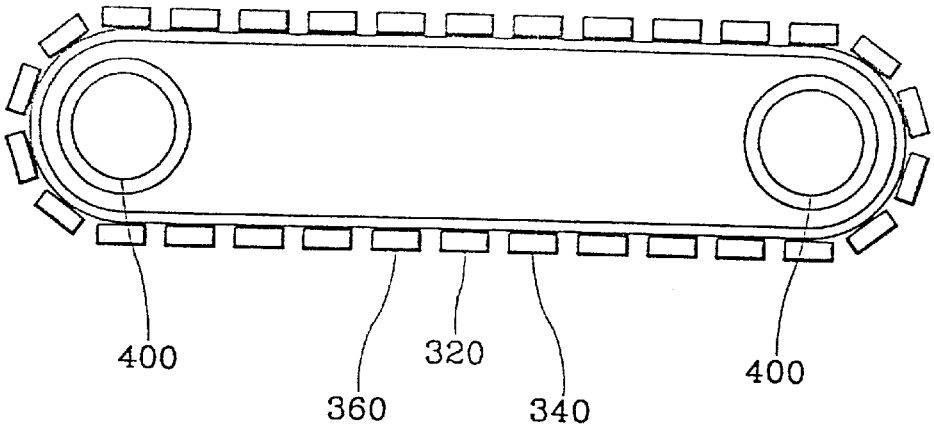
Figure 4:
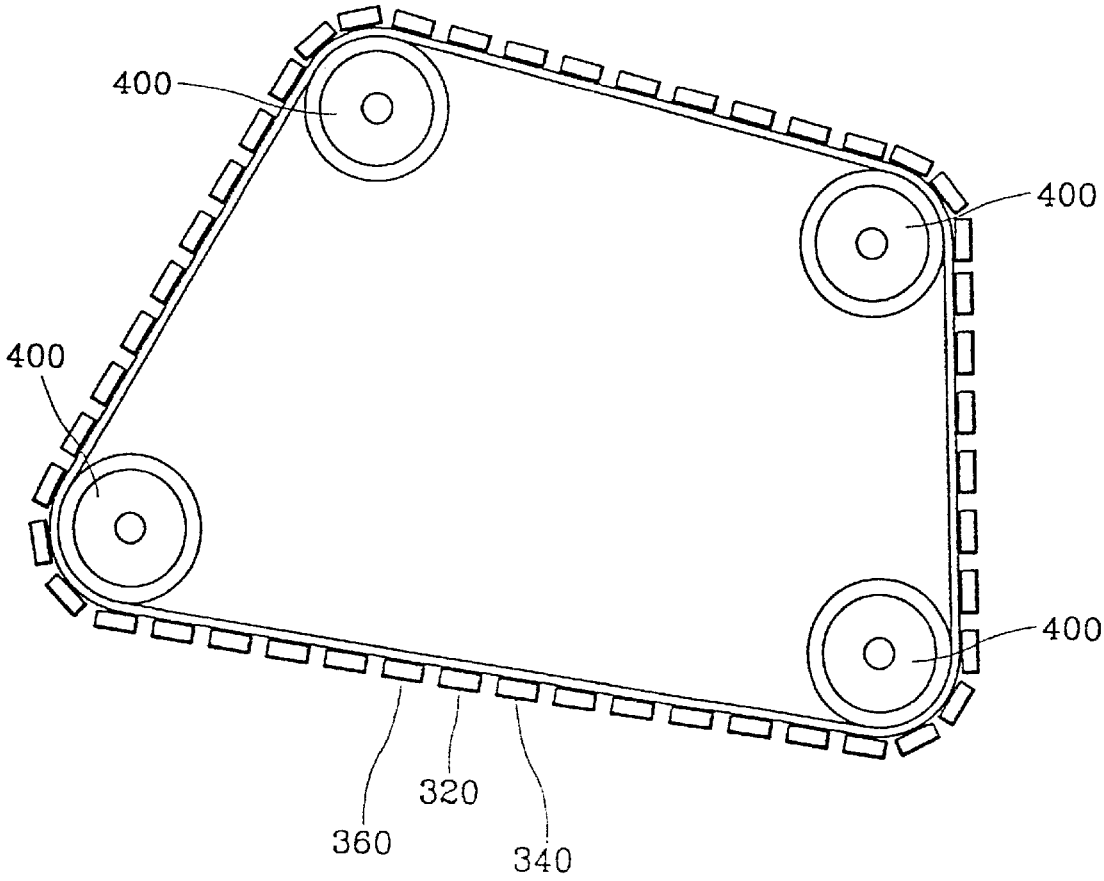

That is, the rotary display assembly 300 is rotated at a speed by the drive motor unit 400 under the control of the controller 200 while displaying images in response to an image display control signal output from the controller 200. In the present invention, the above assembly 300 may have a circular cross-section as shown in FIG. 2. Alternatively, the rotary display assembly 300 may have a longitudinal oval cross-section as shown in. FIG. 3. As a further alternative, the display assembly 300 may have a polygonal cross-section as shown in FIG. 4.

Figure 5:
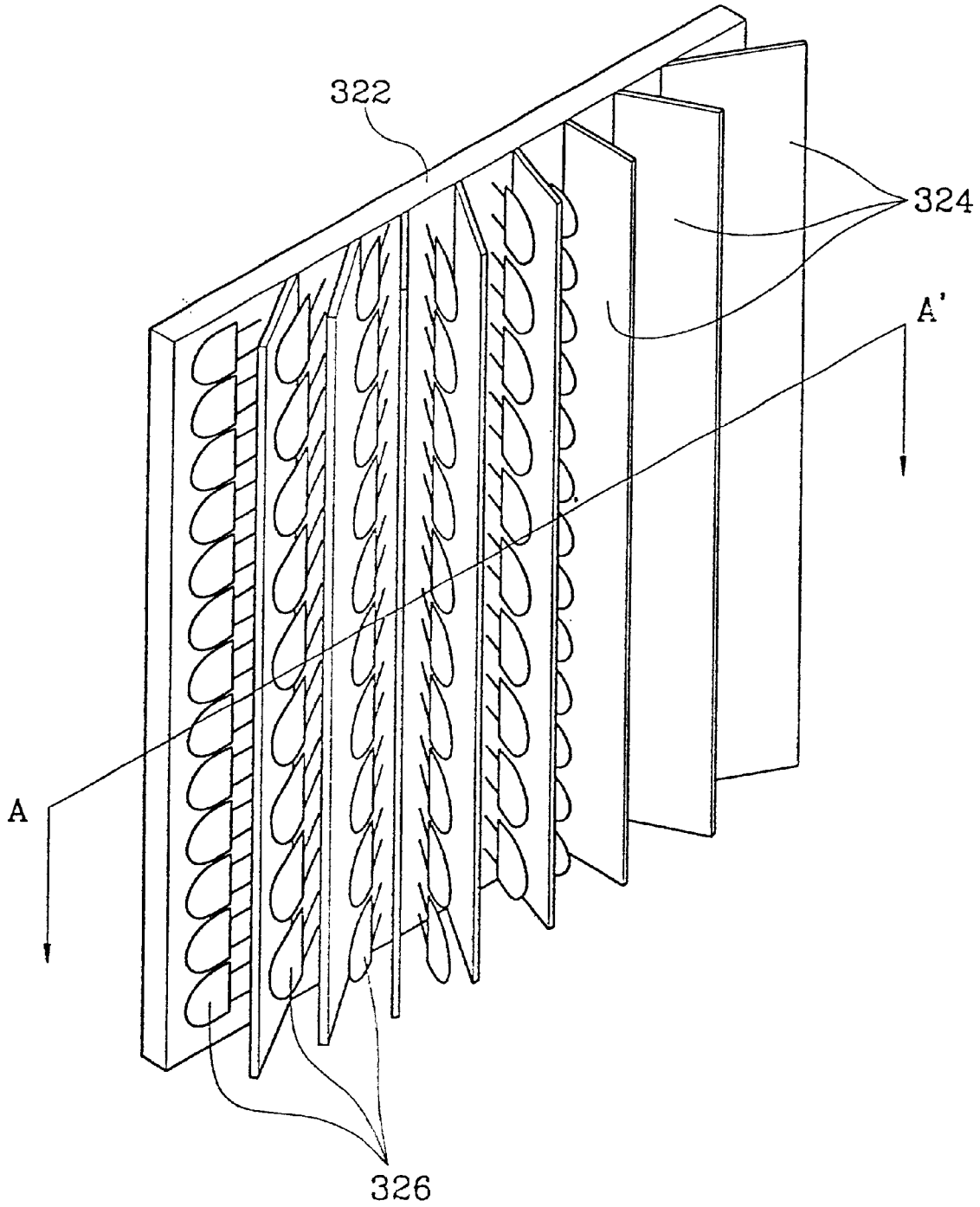
FIG. 5 is a perspective view, showing an arrangement of display elements on each display unit of a rotary display assembly in accordance with the primary embodiment of this invention.
Figure 6:
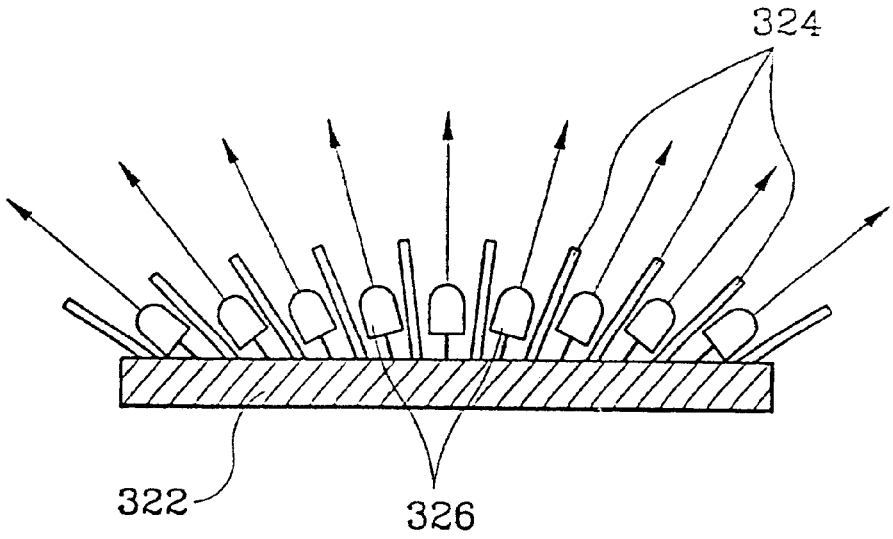
FIG. 6 is a cross-sectional view of the display unit of FIG. 5.

In the primary embodiment of this invention, each or the display units 320, 340 and 360 of she assembly 300 comprises a plurality of display elements 326 which are regularly arranged along a plurality of parallel and vertical rows on a flat mount panel 322, thus forming a display element matrix as shown in FIGS. 5 and 6. The rows of display elements 326 are separated from earn other by a plurality of partition walls 324. That is, the rows of display elements 326 and the partition wants 324 are alternately arranged on one surface of the flat mount panel 322. The alternately arranged display elements 326 and partition walls 324 are regularly and symmetrically inclined relative to the mount panel 322 at multi-angles of inclination, thus being directed in diverged radial directions. The display elements 326 of each display unit 320, 340, 360 thus emit light beams at multi-angles.

Figure 7:
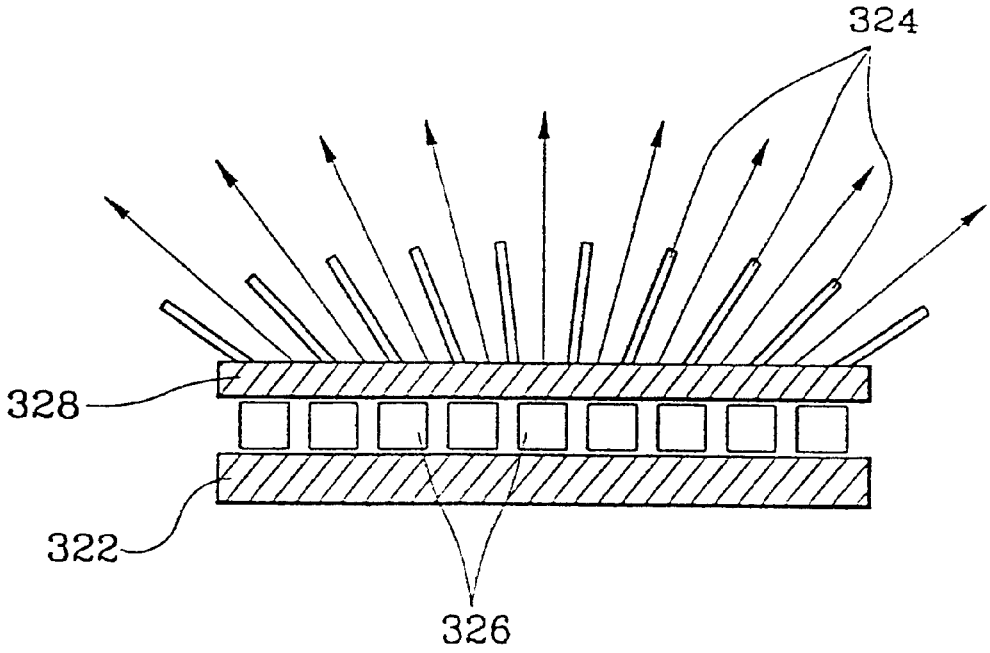
FIGS. 7, 8*a*, 8*b* and 8*c* are cross-sectional views of display units in accordance with the second, third, fourth and fifth embodiments of the present invention, respectively.

FIG. 7 shows an arrangement of display elements 326 on each display unit 320, 340, 360 in accordance with the second embodiment of this invention. In the second embodiment, a plurality of display elements 326 are regularly arranged on one surface of a flat mount panel 322, thus forming a display element matrix. In such a case, the display elements 326 emit light beams in normal directions. One polarizing plate 328 is placed on the display elements 326, thus covering the display elements 326 and polarizing the light beams output from the elements 326. A plurality of partition walls 324 are regularly and symmetrically arranged on the polarizing plate 328 while being inclined relative to the polarizing plate 328 at multi-angles of inclination, thus being directed in diverged radial directions. Therefore, each display unit 320, 340, 360 according to the second embodiment emits light beams at multi-angles.

Figure 8A:
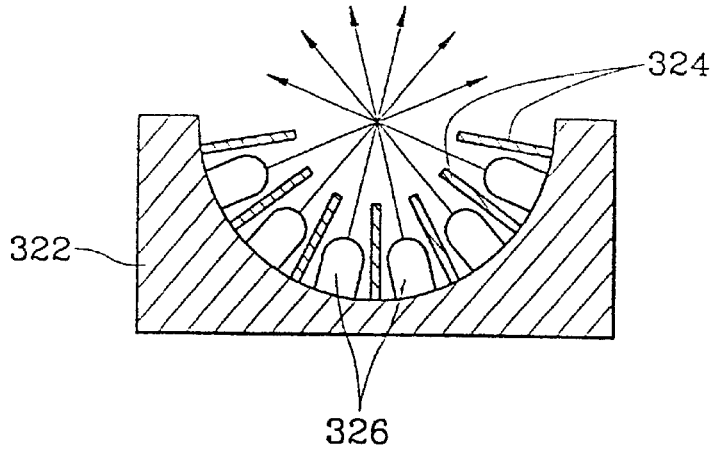

FIG. 8*a* shows an arrangement of display elements 326 on each display unit 320, 340, 360 in accordance with the third embodiment of this invention. In the third embodiment, one surface of the mount panel 322 is concave from the top to the bottom so as to form an arc-shaped surface. A plurality of display elements 326 are regularly arranged along a plurality of parallel and vertical rows on the arc-shaped surface of the panel 322, thus forming a display element matrix. The rows of display elements 326 are separated from each other by a plurality of partition walls 324. That is, the rows of display elements 326 and the partition walls 324 are alternately arranged on the arc-shaped surface of the panel 322. The alternately arranged display elements 326 and partition walls 324 are regularly and symmetrically directed in converged radial directions, so that each display unit 320, 340, 360 emits light beams at multi-angles. Such an arrangement of display elements 326 according to the third embodiment preferably reduces the width of each display unit 320, 340, 360, thus allowing the rotary display assembly 300 to be more precisely manufactured. Another advantage of the above arrangement resides in that it preferably accomplishes an image displaying angle larger than 180°.

Figure 8B:
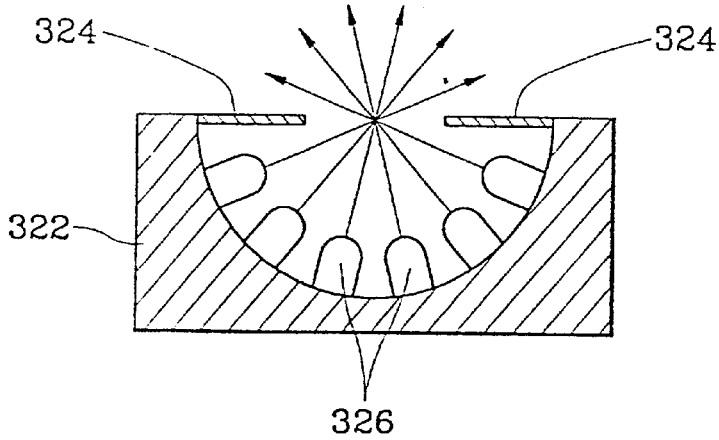

FIG. 8*b* shows an arrangement of display elements 326 on each display unit 320, 340, 360 in accordance with the fourth embodiment of this invention. In the fourth embodiment, one surface of the mount panel 322 is concave so as to form an arc-shaped surface in the same manner as that described for the third embodiment. A plurality of display elements 326 are regularly and symmetrically arranged along a plurality of parallel and vertical rows on the arc-shaped surface of the panel 322, thus forming a display element matrix with the display elements 326 being directed in converged radial directions. Two partition walls 324 are mounted on the panel 322 along both side edges of the arc-shaped surface in a way such that a slot is formed between the two partition walls 324 and allows the light beams from the display elements 326 to be radiated at multi-angles.

Figure 8C:
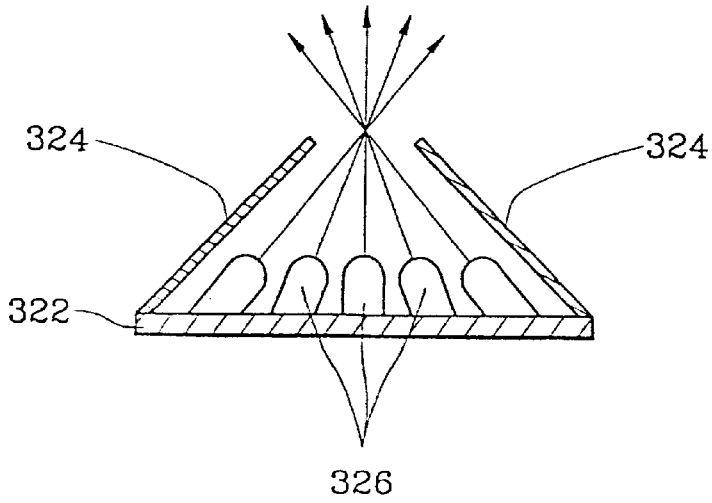

FIG. 8*c* shows an arrangement of display elements 326 on each display unit 320, 340, 360 in accordance with the fifth embodiment of this invention. In the fifth embodiment, a plurality of display elements 320 are regularly arranged along a plurality of parallel and vertical rows on a flat mount panel 322, thus forming a display element matrix. The display elements 326 are also symmetrically inclined relative to the mount pane 322 at multi-angles of inclination, thus being directed in converged radial directions. Two partition walls 324 are mounted on the panel 322 at both side edges of the panel 322 in a way such the two walls 324 are inclined inwardly at an anal of inclination with a slot being formed between the two partition walls 324. The slot of the two partition walls 324 allows the light beams from the display elements 326 to be radiated at multi-angles.

FIGS. 9*a* to 9*d* illustrate a method of accomplishing a high horizontal resolution of the image display device of this invention. As shown in the drawings, a plurality of display units, of which the multi-angles of both the display elements 326 and the partition walls 324 are different from each other, are continuously arranged on a rotary display assembly 300. When the rotary display assembly 300, carrying such display unit, is rotated at a high speed, it is possible to form images having a high horizontal resolution.

FIG. 10 illustrates a method of accomplishing a high vertical resolution of the image display device of this invention. As shown in the drawing, a plurality of display units, of which the vertical intervals of the display element matrices are different from each other, are continuously arranged on a rotary display assembly 300. When the rotary display assembly 300, carrying such display units, is rotated at a high speed, it is possible to form images having a high vertical resolution.

The operational effect of the present invention will be described hereinbelow.

In the operation of the above image display device, the image processing unit 100 may selectively process image data output from compact disks, video cassettes chard disks prior to transmitting the processed image data to the controller 200. Alternatively, the image processing unit 100 may receive public waves, output from a broadcasting station, prior to processing image data of the public waves and transmitting the processed image data to the controller 200.

The controller 200 processes the image data output from the image processing unit 100 prior to generating an image display control signal, which is applied to the rotary display assembly 300 so as to allow said assembly 300 to display desired images. The controller 200 also generates a motor control signal used for rotating the assembly 300 at a desired speed, at which the assembly 300 is rotated with about thirty display units 320, 340 and 360 passing a position in front of a viewer.

That is, the drive motor unit 400 rotates the rotary display assembly 300 at a speed of not lower than 30 revolutions per second in response to the motor control signal output from the controller 200. When the rotary display assembly 300 is rotated by the motor unit 400 as described above, the assembly 300 displays desired images on the display units 320, 340 and 360.

In such a case, the power supply 500 supplies an electric power to each of the display units 320, 340 and 360 of the assembly 300.

Therefore, a viewer around the rotary display assembly 300 can see a desired image from the assembly 300 due to an afterimage caused by an optical illusion of the images formed on the display units 320, 340 and 360.

Figures 11A, 11B, 11C, 11D, 11E:
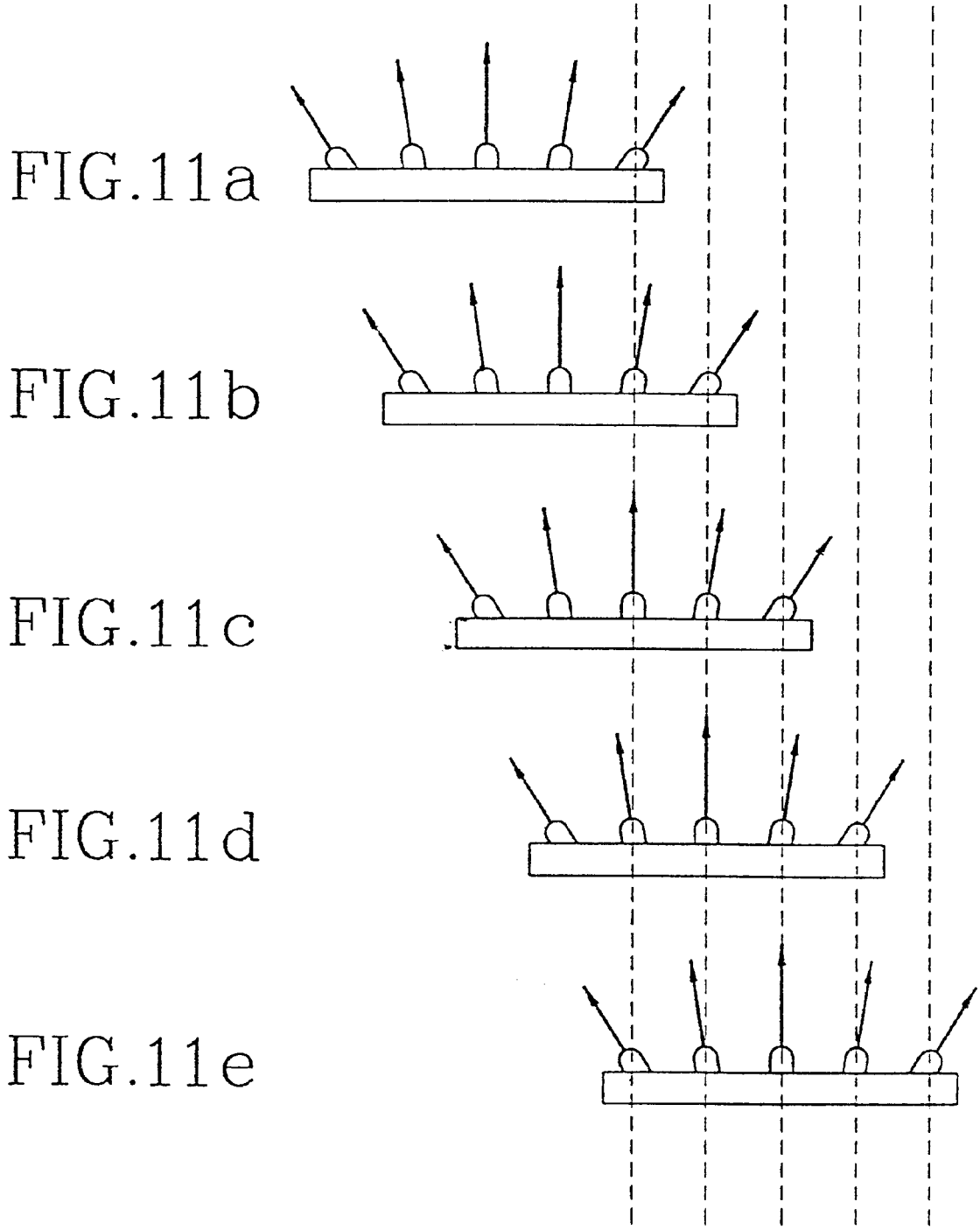
FIGS. 11*a* to 11*e* are views, illustrating the horizontal resolving power of the image display device of this invention.

FIGS. 11*a* to 11*e* are views, illustrating the horizontal resolving power of the image display device of this invention. When the display units 320, 340 and 360, individually emitting light beams at multi-angles, are orderly rotated as shown in FIGS. 11*a* to 11*c*, it is possible to accomplish a desired horizontal resolving power at any position of a viewer as shown in FIG. 11*e*. In such a case, the horizontal resolving power is determined by the number of light beams emitted from the display elements 326 of the display units 320, 340 and 360.

For example, when a rotary display assembly 300, comprising a plurality of display units 320, 340 and 360 with both a plurality of display elements 326, individually having a 5 mm width, and a plurality of partition walls 324 being arranged on each display unit 320, 340, 360 to form thirty different light emitting angles, is rotated at a high speed of not lower than thirty-revolutions per second while displaying images on the display units 320, 340 and 360, a viewer around the assembly 300 can see thirty images at the same time due to an afterimage caused by an optical illusion. When a plurality of image data are orderly moved through the display units of the assembly 300, the viewer can see thirty images at a fixed position.

When each display unit 320, 340, 360 of the rotary display assembly 300 only carries monochrome display elements, the display assembly 300 shows a monochrome image. However, each display unit 320, 340, 360 of the rotary display assembly 300 carries color display elements or R (red), G (green) or B (blue) display elements, the display assembly 300 shows a color image when the assembly 300 is rotated at a high speed. When each display element 326, carried on each display unit 320, 340, 360, is designed to selectively emit R, G or B color light beam, it is possible to form an image having a variety of colors due to an additive color mixture effect.

In the preferred embodiments of this invention, the display elements 326 are arranged on each display unit 320, 340, 360 of the rotary display assembly 300 in a way such that the display elements 326 emit light beams to the outside of the assembly 300. However, it should be understood that the display elements 326 may be arranged on each display unit 320, 340, 360 of the assembly 300 in a way such that the display elements 326 emit light beams to the inside of the assembly 300. In such a case, a viewer, positioned inside the assembly 300, can see an image having an angle of 360°.

Industrial Applicability

As described above, the present invention provides a device and method of displaying images. The device of this invention displays a plurality of images having a high resolution using a rotary display assembly having a circular, longitudinal oval or polygonal cross-section. The device is thus preferably used as an interior instrument or a sign board in a store or an exhibit room.

The device of this invention also displays a plurality of images at multi-angles, thus preferably displaying several images or different program images at the same time. In addition, the device allows a plurality of users to play a multi-user came using one display device.

Another advantage of the invention resides in that since a plurality of display elements emit light beams at multi-angles when a plurality of display units are orderly rotated, it is possible to accomplish a desired horizontal resolving power at a position of viewer, with the horizontal resolving power being determined by the number of light beams emitted from the display elements of the displace units.

Although the preferred embodiments of she present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for displaying images, comprising:

a controller selectively processing image data output from an image processing unit, so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein each of said display units comprises:

a mount panel concave on one surface thereof from the top to the bottom, thus having an arc-shaped surface;

a plurality of display elements regularly arranged along a plurality of parallel and vertical rows on said arc-shaped surface of the mount panel, thus forming a display element matrix and emitting light beams at multiple angles; and a plurality of partition walls positioned between the rows of display elements, thus separating the rows of display elements from each other and allowing the light beams, emitted from the display elements, to be radiated at multiple angles.

2. The device according to claim 1, wherein the light beam emitting angles of the display units are different from each other in accordance with the order of said display units, thus allowing the rotary display assembly to display an image having a high horizontal resolution when the display assembly is rotated at a high speed.

3. The device according to claim 1, wherein vertical intervals of the display element matrices carried on the display units are different from each other, thus allowing the rotary display assembly to display an image having a high vertical resolution when the display assembly is rotated at a high speed.

4. The device according to claim 1, wherein the display elements of the display units individually and selectively emit a red, green or blue light beam, thus allowing the rotary display assembly to display a color image.

5. The device according to claim 1, wherein the display elements, carried on each of said display units, emit red, green or blue light beams, thus allowing the rotary display assembly to display a color image.

6. The device according to claim 1, wherein said rotary display assembly has a polygonal cross-section.

7. The device according to claim 1, wherein said rotary display assembly has a circular cross-section.

8. A device for displaying images, comprising:

a controller selectively processing image data output from an image processing unit so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein each of said display units comprises:

a flat mount panel; and a plurality of display elements regularly arranged along a plurality of parallel and vertical rows on one surface of said flat mount panel, thus forming a display element matrix with a plurality of partition walls being positioned between the rows of display elements, said rows of display elements along with the partition walls being symmetrically inclined so as to emit light beams at multiple angles.

9. A device for displaying images, comprising:

a controller selectively processing image data output from an image processing unit so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein each of said display units comprises:

a mount panel concave on one surface thereof from the top to the bottom, thus having an arc-shaped surface;

a plurality of display elements regularly and symmetrically arranged along a plurality of parallel and vertical rows on the arc-shaped surface of the mount panel, thus forming a display element matrix and emitting light beams at multiple angles; and two partition walls mounted on said mount panel at both side edges of the arc-shaped surface so as to form a slot between them, said slot having a predetermined width and allowing the light beams, emitted from the display elements, to be radiated at multiple angles.

10. A device for displaying images, comprising:

a controller selectively processing image data output from an image processing unit so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein each of said display units comprises:

a flat mount panel;

a plurality of display elements regularly arranged along a plurality of parallel and vertical rows on said flat mount panel, thus forming a display element matrix and emitting light beams at multiple angles; and two partition walls mounted on said flat mount panel at both side edges of the panel while being inclined inwardly at an angle of inclination, thus forming a slot between them, said slot having a predetermined width and allowing the light beams, emitted from the display elements, to be radiated at multiple angles.

11. A device for displaying images, comprising:

a controller selectively processing image data output from an image processing unit so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein each of said display units comprises:

a flat mount panel;

a plurality of display elements regularly arranged along a plurality of parallel and vertical rows on one surface of said flat mount panel, thus forming a display element matrix and emitting light beams in normal directions;

a polarizing plate covering the display elements so as to polarize the light beams emitted from the display elements; and a plurality of partition walls regularly and symmetrically arranged on said polarizing plate so as to radiate the polarized light beams at multiple angles.

12. A device for displaying images, comprising:

a controller selectively processing image data output from an image processing unit so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein said display units of the rotary display assembly are arranged on the assembly so as to display images inside the assembly, and wherein each of said display units comprises:

a mount panel concave on one surface thereof from the top to the bottom, thus having an arc-shaped surface;

a plurality of display elements regularly arranged along a plurality of parallel and vertical rows on said arc-shaped surface of the mount panel, thus forming a display element matrix and emitting light beams at multiple angles; and a plurality of partition walls positioned between the rows of display elements, thus separating the rows of display elements from each other and allowing the light beams, emitted from the display elements, to be radiated at multiple angles.

13. The device according to claim 12, wherein the light beam emitting angles of the display units are different for each other in accordance with the order of said display units, thus allowing the rotary display assembly to display an image having a high horizontal resolution when the display assembly is rotated at a high speed.

14. The device according to claim 12, wherein vertical intervals of the display element matrices carried on the display units are different from each other, thus allowing the rotary display assembly to display an image having a high vertical resolution when the display assembly is rotated at a high speed.

15. The device according to claim 12, wherein the display elements of the display units individually and selectively emit a red, green or blue light beam, thus allowing the rotary display assembly to display a color image.

16. The device according to claim 12, wherein the display elements, carried on each of the display units, emit red, green or blue light beams, thus allowing the rotary display assembly to display a color image.

17. The device according to claim 12, wherein said rotary display assembly has a polygonal cross-section.

18. The device according to claim 12, wherein said rotary display assembly has a circular cross-section.

19. A device for displaying images, comprising:

a controller selectively processing image data output from an image processing unit so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein said display units of the rotary display assembly are arranged on the assembly so as to display images inside the assembly, and wherein each of said display units comprises:

a flat mount panel; and a plurality of display elements regularly arranged along a plurality of parallel and vertical rows on one surface of said flat mount panel, thus forming a display element matrix with a plurality of partition walls being positioned between the rows of display elements, said rows of display elements along with the partition walls being symmetrically inclined so as to emit light beams at multiple angles.

20. A device for displaying images, comprising:

a controller selectively processing image data output from an image processing unit so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein said display units of the rotary display assembly are arranged on the assembly so as to display images inside the assembly, and wherein each of said display units comprises:

a mount panel concave on one surface thereof from the top to the bottom, thus having an arc-shaped surface;

a plurality of display elements regularly and symmetrically arranged along a plurality of parallel and vertical rows on the arc-shaped surface of the mount panel, thus forming a display element matrix and emitting light beams at multiple angles; and two partition walls mounted on said mount panel at both side edges of the arc-shaped surface so as to form a slot between them, said slot having a predetermined width and allowing the light beams, emitted from the display elements, to be radiated at multiple angles.

21. A device for displaying images, comprising:

a controller selectively processing image data output from an image processing unit so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein said display units of the rotary display assembly are arranged on the assembly so as to display images inside the assembly, and wherein each of said display units comprises:

a flat mount panel;

a plurality of display elements regularly arranged along a plurality of parallel and vertical rows on said flat mount panel, thus forming a display element matrix and emitting light beams at multiple angles; and two partition walls mounted on said flat mount panel at both side edges of the panel while being inclined inwardly at an angle of inclination, thus forming a slot between them, said slot having a predetermined width and allowing the light beams, emitted from the display elements, to be radiated at multiple angles.

22. A device for displaying images, comprising:

a controller selectively processing image data output from an image processing unit so as to generate an image display control signal, said controller also generating a motor control signal;

a drive motor unit selectively rotated at a speed in response to the motor control signal output from said controller; and a rotary display assembly comprising a plurality of image display units capable of individually emitting light beams at multiple, partitioned angle ranges, said assembly being rotatable at a speed by drive motor unit and selectively displaying images on said display units in response to image display control signal output from the controller, wherein said display units of the rotary display assembly are arranged on the assembly so as to display images inside the assembly, and wherein each of said display units comprises:

a flat mount panel;

a plurality of display elements regularly arranged along a plurality of parallel and vertical rows on one surface of said flat mount panel, thus forming a display element matrix and emitting light beams in normal directions;

a polarizing plate covering the display elements so as to polarize the light beams emitted from the display elements; and a plurality of partition walls regularly and symmetrically arranged on said polarizing plate so as to radiate the polarized light beams at multiple angles.

* * * * *